United States Patent [19]

Trudell

[11] Patent Number: 4,744,233

[45] Date of Patent: May 17, 1988

[54] APPARATUS FOR BENDING RECTANGULAR TUBES

[75] Inventor: Gerald R. Trudell, Pinconning, Mich.

[73] Assignee: AP Industries, Inc., Toledo, Ohio

[21] Appl. No.: 884,974

[22] Filed: Jul. 14, 1986

[51] Int. Cl.[4] ..... B21D 9/05

[52] U.S. Cl. ..... 72/150; 72/154; 72/159; 72/466

[58] Field of Search ..... 72/150, 154–156, 72/158, 159, 466, 43, 369, 370; 15/104.33

[56] References Cited

U.S. PATENT DOCUMENTS

| | | | |
|---|---|---|---|
| 588,223 | 8/1897 | Fowler | 72/158 |
| 878,604 | 2/1908 | Brinkman | 72/155 |
| 1,660,999 | 2/1928 | MacDonell | 15/104.33 |
| 1,978,452 | 10/1934 | Flodin | 72/466 |
| 2,057,359 | 10/1936 | Baker | 72/369 |
| 2,740,454 | 4/1956 | Fuchs, Jr. | 72/155 |
| 2,777,500 | 1/1957 | Ekholm et al. | 72/150 |
| 2,962,077 | 11/1960 | Condiff | 72/149 |
| 3,650,136 | 3/1972 | Sindelar | 72/150 |
| 4,671,096 | 6/1987 | Crosby | 72/466 |

FOREIGN PATENT DOCUMENTS

| | | | |
|---|---|---|---|
| 301205 | 4/1971 | U.S.S.R. | 72/466 |
| 963609 | 2/1983 | U.S.S.R. | 72/466 |

*Primary Examiner*—Daniel C. Crane

*Attorney, Agent, or Firm*—Anthony J. Casella; Gerald E. Hespos

[57] ABSTRACT

A bending apparatus is provided for rectangular tubes. The apparatus comprises a bending die, a wiper die, a clamp die, a pressure die and a mandrel. The clamp die and pressure die are provided with tongues which are engageable in corresponding grooves in the bending and wiper dies. The tongues and the clamping and pressure surfaces of the respective dies are dimensioned to enable the rectangular tube to be bent about either of its two axes by placing the tube on either of the opposed sides of the respective tongues. The tongue of the pressure die is movable to facilitate the tangential advancement of the pressure die under the action of a booster for urging the tubing into the bend. The mandrel includes a plurality of movable blocks. A plurality of springs interconnect the blocks to facilitate alignment. The blocks are mounted to a replaceable head which can be removed and replaced when worn. The mandrel includes channels for lubrication.

25 Claims, 3 Drawing Sheets

APPARATUS FOR BENDING RECTANGULAR TUBES

BACKGROUND OF THE INVENTION

For years virtually all vehicles were manufactured with a frame to which the body, the engine and the various driving, steering and suspension components were mounted. Gradually, most automobiles were redesigned to employ a unibody construction. The unibody construction incorporates the structural support of the automobile into the body, thereby avoiding the need for a separate frame. It has been accepted that the unibody construction provides adequate strength for automobiles with a savings in both weight and cost. Frames still are employed on many trucks, vans and other commercial or recreational vehicles. Frames are considered to provide somewhat greater strength, which may occasionally be required on these other vehicles. However, the experience with unibody construction has encouraged the manufacturers of these vehicles to explore more efficient, lighter and less expensive alternatives to the standard frame construction.

The typical vehicular frame has been formed from an array of beam-like elongated structural members. On the typical frame, the structural members would define a generally U-shape cross section. Recently, vehicle manufacturers have considered employing rectangular tubing in vehicular frames. Rectangular tubing would provide an advantageous strength-to-weight ratio as compared to the prior art vehicular frames. More particularly, tubing with fairly thin walls could be employed instead of the heavier beam-like structures of prior art frames. Additionally, tube manufacturing is a fairly advanced art that is well suited to automation. Furthermore, sophisticated automatic bending machines have been developed for use with circular tubing. These automated benders are preprogrammable for a plurality of different bending patterns. Once one of the preprogrammed patterns is selected, the bending machine will automatically advance the tube both longitudinally and rotationally to selected locations where an appropriate bend is placed. It was hoped that the recently developed automatic benders for circular tubes could be employed to bend rectangular tubes for incorporation into a lightweight but strong vehicular frame.

The prior art tube bending apparatus employs a bending die which includes an arcuate outer surface around which the tube is bent. The radius of the outer surface of this bending die defines the radius of curvature of the bent tube. The degree of curvature is determined by the angular extent to which the tube is bent around the bending die. The typical programmable bending apparatus enables the degree of curvature to be varied from one curve to the next along a length of tubing in accordance with the preprogrammed parameters. In the bending apparatus for circular tubing, the bending die will include a semicircular groove into which the tubing is urged.

The prior art bending apparatus also includes a pressure die and a clamp die, each of which is provided with a groove configured to enable the dies to securely retain the tube. The principal function of the pressure die is to hold the tubing in a position generally tangent to the bending die. The clamp die, on the other hand, moves through a circular arc around the bending die, and is operative to bend the tube the required preprogrammed amount.

The prior art programmable bending apparatus further includes a means for longitudinally and rotationally advancing the tube from one bend location to the next. Additionally, the prior art programmable bending apparatus will include a control means which is operative to control the longitudinal and rotational advancement of the tube plus the degree of curvature at each bend.

All tube bending effectively stretches the portion of the tube on the outside of the bend, while compressing the portion of the tube on the inside of the bend. Mandrels are employed to prevent or minimize changes to the original cross-sectional shape in the bent portion of the tube. The prior art mandrel includes an elongated substantially rigid portion having a plurality of short portions articulated to the end. The mandrel is dimensioned to fit tightly within the tube, and the articulated portions thereof are disposed in the tube substantially at the point of the bend. The mandrel generally is lubricated to facilitate relative movement between the mandrel and the tube.

The prior art bending apparatus may also include a pressure die booster cylinder which will cause the pressure die to advance in a longitudinal direction. This movement of the pressure die is operative to feed tubing into the bend thereby preventing excessive thinning or rupture adjacent the outer surface of the tube.

Initial attempts to adapt the known automatic bending machines to rectangular tubing resulted in several significant problems. One such problem concerned the cross-sectional shape of the various dies employed in the bending apparatus. Specifically, circular tubing is symmetrical about any and all cross-sectional axes. Thus, the dies are provided with semicircular grooves which reflect the circular configuration of the tubing. The dies are able to securely grip the circular tubing even though the tubing is periodically rotated to effect bends through different planes. Rectangular tubing, on the other hand, is not symmetrical about all of its axes. When the rectangular tubes are to be employed in vehicular frames, the bends may be about either the long rectangular axis or the short rectangular axis. However, a single groove in the dies cannot securely grip the tube for bending around either of these differently dimensioned axes.

A second substantial problem encountered in the bending of rectangular tubes relates to the differences between the bending characteristics of circular and rectangular tubes respectively. For example, when a circular tube is bent, the neutral axis, or the axis which neither stretches or compresses is disposed very near the centerline of the tubing. Furthermore, the circular configuration contributes to a gradual change in the thickness of the tube wall. With rectangular tubes, however, the neutral axis tends to be located very close to the radially innermost bent surface of the rectangular tube. As a result, the radially outer portions of the tube undergo a proportionally greater amount of stretching, and the outermost wall will be substantially thinned. Furthermore, the rectangular configuration does not yield the gradual dimensional changes which are achieved with circular tubing. In view of these bending characteristics of rectangular tubing, there is a substantial probability of failure in the tube during the bending process. As noted previously, the standard prior art technique for preventing excessive thinning and related failures is to provide a pressure die booster which urges the tube into the bend. However, the prior art does not provide a pressure die that can both adequately support a rectangular tube and enable efficient action by a pressure die booster. More particularly, the radially innermost portion of the prior art pressure die will be urged into contact with the radially innermost portion of the clamp die. However, as the clamp die advances through its arc, the radially inner-most portion of the clamp die will move less than the radially outermost portion. Consequently, a generally pie-shaped wedge will develop between the pressure and bending dies. The movement of the prior art pressure die will be limited by the relatively small movement of the radially innermost portion of the clamp die. Therefore, the prior art pressure die will not be able to advance sufficiently to feed the required amount of tubing into the bend for preventing the excessive thinning associated with the radially outer walls of rectangular tubes.

Another problem related to the excessive thinning of the radially outer walls of rectangular tubes concerns the ability of the prior art clamp die to securely and properly grip the tube through the bend. More particularly, the excessive thinning causes the clamp die to grip the tube in either a leading or trailing position. Furthermore, the stretching of the tube causes the prior art clamp die to create severe machining marks in the outer radial surface of the bend.

The above described bending characteristics of rectangular tubes also creates substantial stresses upon the mandrel. Consequently, lubrication becomes especially critical. Even with efficient lubrication, the extreme ends of the mandrel are subject to excessive wear. Wear also occurs as a result of attempts to insert a nonsymmetrical mandrel into a nonsymmetrical tube. Specifically, the articulated portions of the prior art rectangular mandrel may become misaligned with respect to one another and with respect to the tube.

In view of the above, it is an object of the subject invention to provide a bending apparatus for rectangular tubes.

It is another object of the subject invention to provide a bending apparatus that can bend a rectangular tube efficiently around each of two unequal cross-sectional axes.

Another object of the subject invention is to provide a bending apparatus for rectangular tubes wherein a pressure die is able to effectively urge the tubing into the bend.

An additional object of the subject invention is to provide a bending apparatus for rectangular tubes wherein the clamp die securely grips the rectangular tubing throughout the entire bend.

Still another object of the subject invention is to provide a bending apparatus and mandrel for a rectangular tube wherein the mandrel efficiently provides lubrication to the area of the bend.

A further object of the subject invention is to provide a bending apparatus and mandrel for rectangular tubing wherein the costs associated with excessive wear can be minimized.

Yet another object of the subject invention is to provide a bending apparatus and mandrel for rectangular tubing wherein the mandrel is self-aligning.

SUMMARY OF THE INVENTION

The subject invention is directed to a bending apparatus specifically adapted for bending rectangular tubes which may include unequal major and minor cross-sectional dimensions or which may be square. The apparatus comprises a bending die, a clamp die and a pressure die, all of which are specifically adapted for use with one another as explained below.

The bending die includes a bending surface which defines an arc of a cylinder about which the rectangular tube will be bent. First and second end supports may be mounted to opposed ends of the bending surface and extend outwardly therefrom. The end supports may be generally circular, and may have a radial dimension greater than the radius of the cylindrical bending surface by an amount substantially equal to the major or minor cross-sectional dimension of the rectangular tube. The axial length of the bending surface is sufficient to enable the rectangular tube to be disposed intermediate the end supports, such that an outer surface of the rectangular tube can be disposed tangent to the bending surface and such that at least one adjacent outer surface of the rectangular tube can be disposed substantially in face-to-face contact with at least one end support of the bending die. In a preferred embodiment, the bending surface includes a groove disposed intermediate the end supports. More particularly, the groove will be spaced from the first end support of the bending die a distance substantially equal to the major external dimension of the tube, while the distance between the groove and the second end support of bending die will be substantially equal to the minor dimension of the tube.

The bending apparatus also preferably comprises a wiper die which defines a trailing tangential support. The wiper die further includes end supports which are disposed substantially in the same plane as the end supports of the bending die. The tangential surface of the wiper die has a height substantially equal to the axial dimension of the bending surface of the bending die. Furthermore, on certain preferred embodiments, the tangential surface of the wiper die will be provided with a groove disposed therein to be substantially in line with the groove in the bending surface of the bending die.

The bending apparatus of the subject invention further includes a pressure die which is movable into position opposite the wiper die and opposite a portion of the bending die. The pressure die may be substantially adjacent the respective end supports of the bending die. The principal function of the pressure die is to urge the rectangular tube into both the bending die and the wiper die. The pressure die may further include a pressure die booster cylinder which is operative to urge the pressure die in a generally tangential direction progressing from the wiper die toward the bending die. In this manner, the pressure die is operative to urge the rectangular tubing into the bend to be effected by the bending die.

The pressure die may further include a generally planar tongue disposed in a plane extending parallel to a radius of the bending die and disposed to be in line with the grooves in both the bending die and the wiper die. The surfaces of the pressure die which extend generally perpendicularly from the tongue define first and second pressure surfaces which do not lie in a common plane. Rather, the first and second pressure surfaces are parallel but offset with respect to one another by a distance substantially equal to the difference between the major and minor external dimensions of the rectangular tube. Furthermore, the offset first and second pressure surfaces will be disposed such that the rectangular tube can be securely engaged in one alignment between the first pressure surface, the tongue, the first end support of the bending die, and the bending surface of the bending die. The rectangular tube may then be rotated 90° to be engaged between the second pressure surface, the tongue, the second end support of the bending die and the bending surface of the bending die.

Preferably, at least part of the tongue is movable relative to the remainder of the pressure die to prevent restrictive contact between the radially inner leading corner of the pressure die and the radially inner trailing corner of the clamp die. More particularly, at least part of the tongue is biased into a position away from the pressure die booster. However, a sufficient tangential force on the tongue by the clamp die will urge the movable portion of the tongue toward the pressure die booster. Conversely, a resistance imposed upon the leading inner corner of the tongue will enable the remainder of the pressure die including the pressure surfaces, to move in a generally tangential direction under the action of the pressure die booster, despite the restricted movement of the tongue.

The bending apparatus further includes a clamp die which is operative to grasp the rectangular tubing and to bend the rectangular tubing around the bending die described above. The clamp die includes a cross-sectional configuration substantially identical to the cross section of the pressure die. More particularly, the preferred embodiment of the clamp die includes a tongue disposed to engage the groove in the bending die and to lie in substantially the same plane as the tongue of the pressure die. The clamp die further includes a clamping plate with first and second clamping surfaces disposed on opposite sides of the tongue. Preferably the clamping surfaces are parallel to one another, but are disposed in offset relationship to enable the bending apparatus to bend the rectangular tubing about two different axes. The first and second clamping surfaces are disposed to be substantially in line with the first and second pressure surfaces of the pressure die prior to the start of a bending operation. Preferably, the clamping surfaces are serrated to improve the gripping power of the clamping die.

To ensure optimum and uniform forces exerted by the clamp die throughout the bend, the clamping surfaces are capable of a small amount of pivotal movement about an axis extending perpendicular to the tongue. More particularly, the clamp die includes a support plate which is spaced slightly from the clamping plate. The spacing is defined by a fulcrum pin which may be at least partly disposed within the support plate. The clamping plate then may move about the fulcrum slightly to accommodate the thinning of the outer wall of the rectangular tube as the bend progresses. This pivoting action prevents one edge of the clamping surface from digging into the tube and forming machining marks thereon.

The bending apparatus further includes a rectangular mandrel dimensioned to be slidably inserted into the rectangular tube. The mandrel includes a substantially rigid arm and a plurality of rectangular blocks pivotally mounted thereto. Since the rectangular tube is to be rotated about more than one axis, the pivotal connection is in the form of a ball and socket to ensure a full range of movement of the blocks relative to one another. However, to ensure that the blocks properly align with the rigid arm of the mandrel as the mandrel is being inserted into the tube, a plurality of self-aligning biasing means are provided between the blocks and the rigid arm. The biasing means will permit the full range of pivotal motion required by the mandrel, but will also return the blocks substantially to their initial rectilinear alignment after the mandrel has been removed from the tube. This self-aligning greatly facilitates automation in that each mandrel block does not have to be manually aligned for each tube.

Substantial forces are placed upon the mandrel during a bending operation. As a result, the mandrel must be lubricated. The mandrel of the subject invention facilitates this lubrication by providing a central channel extending through the length of the rigid arm. A plurality of lubricating channels extend from the central channel to the periphery of the mandrel. A lubricating fluid then may be directed through the central channel of the rigid mandrel arm and then through the lubricating channels.

Despite the frequent lubrication, the end of the mandrel adjacent the bend is subject to considerable wear. More particularly, the bending forces tend to place the greatest wear at the extreme end of the rigid arm and on the rectangular blocks adjacent thereto. In the prior art mandrel, it was necessary to replace the entire mandrel once this wear reached a critical point. However, the mandrel of the subject invention includes a replaceable head which is securely but removably affixed to the rigid arm. Most of the wear on the mandrel will take place on this removable portion. When the wear reaches a critical stage, the head can be replaced, but the costly rigid arm can be retained.

DETAILED DESCRIPTION OF THE PREFERRED EMBODIMENT

Figure 1:
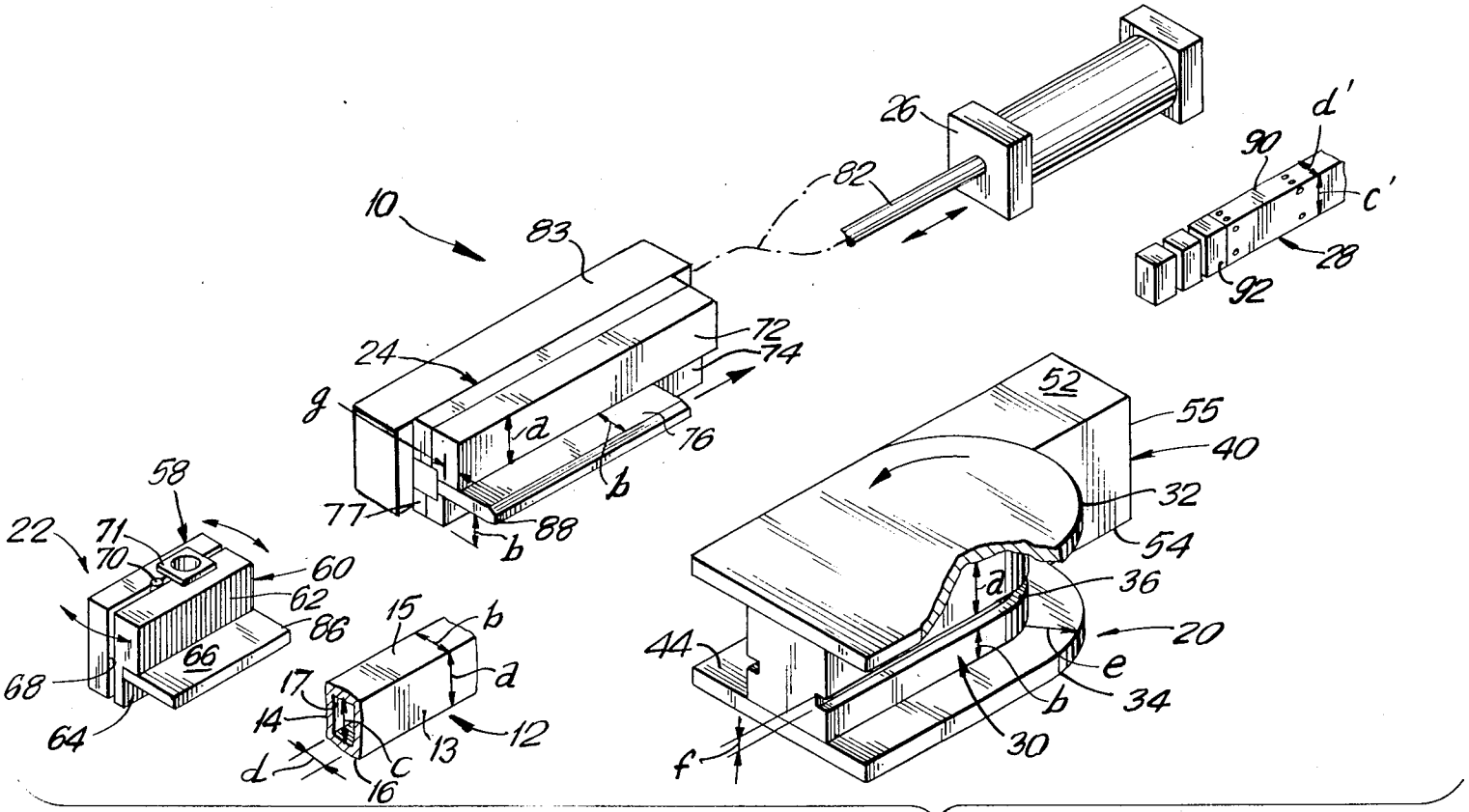
FIG. 1 is an exploded perspective view of the bending apparatus of the subject invention.
Figure 2:
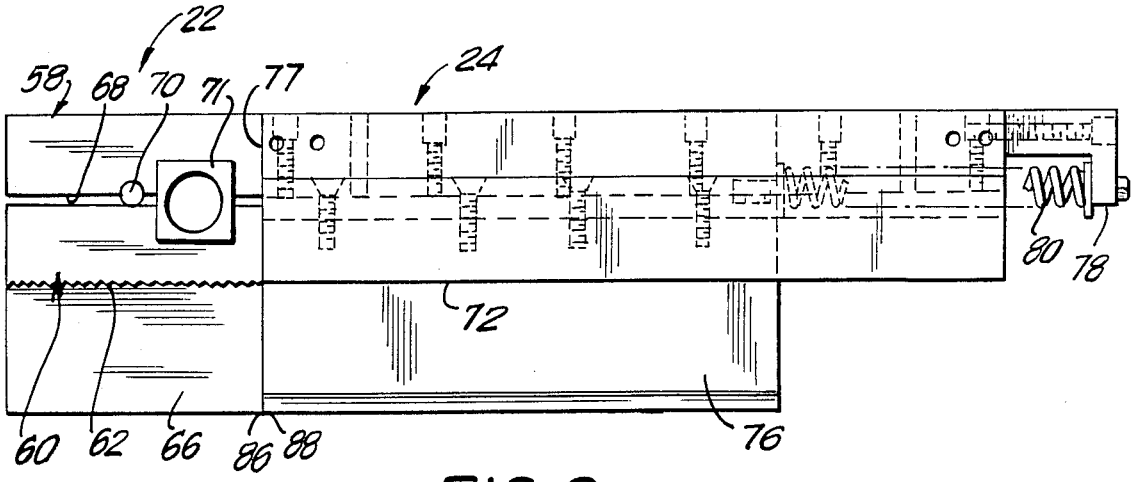
FIG. 2 is a top elevational view of the pressure die and clamp die of the bending apparatus shown in FIG. 1.

The bending apparatus of the subject invention is indicated generally by the numeral 10 in FIG. 1. The bending apparatus 10 is specifically adapted for bending a rectangular tube 12. The tube 12 includes opposed parallel major sides 13 and 14, and opposed parallel minor sides 15 and 16. The external dimensions of the tube 12 are indicated by dimensions "a" and "b" as shown in FIG. 1, wherein dimension "a" is greater than dimension "b." The major sides 13 and 14 and minor sides 15 and 16 of rectangular tube 12 define a generally rectangular through channel 17 which is characterized by a major dimension "c" and a minor dimension "d."

The bending apparatus 10 further includes a bending die 20, a clamp die 22, a pressure die 24, a pressure die booster 26 and a mandrel 28, all of which are described in detail below.

The bending die 20 comprises a bending surface 30 and opposed first and second support plates 32 and 34, which are mounted respectively at the opposed ends of the bending surface 30 and are perpendicular thereto. The support plates 32 and 34 extend outwardly from the bending surface 30 by a distance "e" which is equal to or slightly greater than the major external dimension "a" of the rectangular tube 12.

The bending surface 30 of bending die 20 includes a groove 36. The groove 36 is spaced from the first support plate 32 by distance "a" which, as noted above, corresponds to the major external width of the rectangular tube 12. Similarly, the distance between the groove 36 and the second support plate 34 is substantially equal to dimension "b", which corresponds to the minor external width of the rectangular tube 12.

Figure 3:
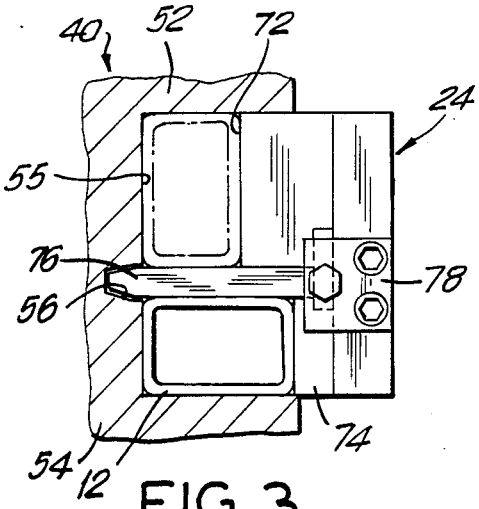
FIG. 3 is a cross-sectional view of the bending apparatus showing the pressure die thereof.

The bending apparatus 10 further comprises wiper die 40. The wiper die 40 is provided with first and second supports 52 and 54 which lie substantially in the same plane as support plates 32 and 34 of the bending die 20. The wiper die 40 further includes a tangential support surface 55, which, as shown most clearly in FIG. 3, is provided with a groove 56. The groove 56 of the wiper die 40 is substantially in line with and is dimensioned the same as the groove 36 on the bending die 20.

The clamp die 22 of the bending apparatus 10 includes a supporting plate 58 and a clamping plate 60. The clamping plate 60 includes a major clamping surface 62 and a minor clamping surface 64. A tongue 66 extends from the clamping plate 60 generally perpendicular to and intermediate the major and minor clamping surfaces 62 and 64. The tongue 66 has a thickness "f" which is substantially equal to the width of the grooves 36 and 56 in the bending die 20 and the wiper die 40. The height of the major clamping surface 62 measured perpendicular to the tongue 66 is indicated by dimension "a" and is substantially equal to the major external width of the rectangular tube 12. Furthermore, as indicated above, this dimension is substantially equal to the distance between the groove 36 and the first support plate 32 of the bending die 20. The width of the tongue 66 measured perpendicular to the major clamping surface 62 is indicated by dimension "b" and is substantially equal to the minor external width of the rectangular tube 12 plus the depth of groove 36 or 56.

Figure 4:
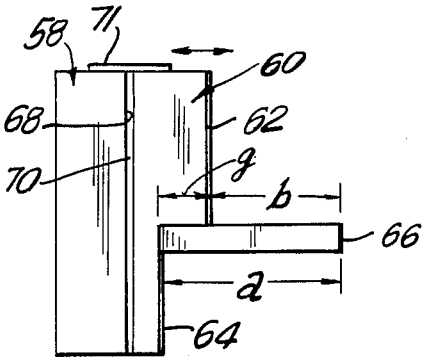
FIG. 4 is an end view of the clamping die of the subject invention.
Figure 5:
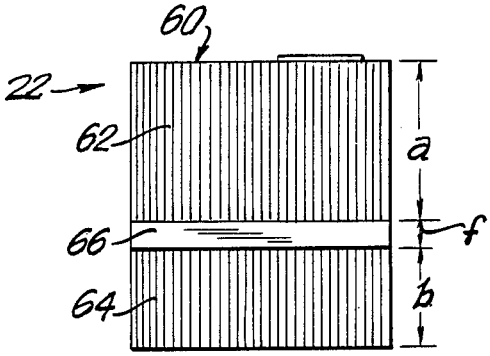
FIG. 5 is a front elevational view of the clamping die of the subject invention.
Figure 6:
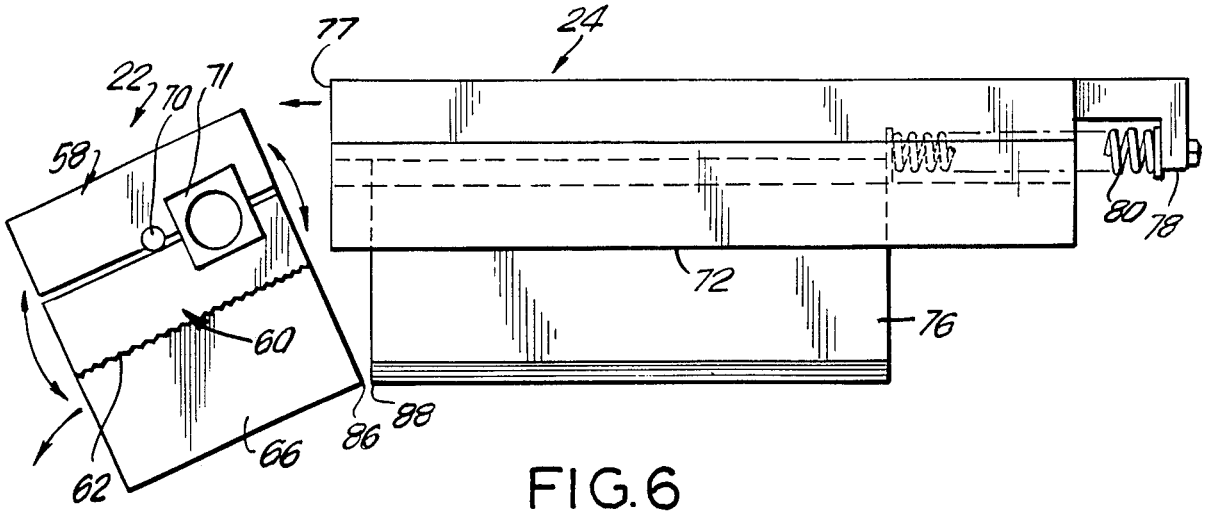
FIG. 6 is a top plan view of the pressure die and the clamping die of the subject invention at one stage during a bending operation.
Figure 7:
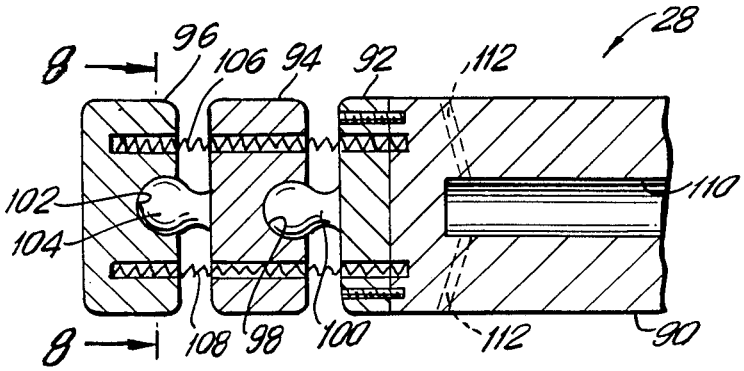
FIG. 7 is a cross-sectional view of the mandrel of the subject invention.
Figure 8:
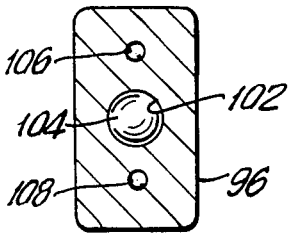
FIG. 8 is a cross-sectional view taken along line 8—8 in FIG. 7.

As shown most clearly in FIG. 4, the minor clamping surface 64 is offset from the major clamping surface 62, but is parallel thereto. The height of the minor clamping surface 64, as measured perpendicular to the tongue 66, is indicated by dimension "b" in FIG. 4 and is substantially equal to the minor external width of the rectangular tube 12. This height of the minor clamping surface 64 also is substantially equal to the distance between the groove 36 and the second support plate 34 on the bending die 20. The width of the tongue 66 as measured from the minor clamping surface 64 is indicated by dimension "a" which is substantially equal to the major external width of the rectangular tube 12 plus the depth of groove 36 or 56. As shown most clearly in FIGS. 1 and 5, the major and minor clamping surfaces 62 and 64 both are provided with a plurality of serrations extending generally perpendicular to the plane of the tongue 66. The serrations enhance the gripping ability of the clamping plate 60.

The supporting plate 58 of clamp die 22 includes generally planar surface 68 which is substantially adjacent the clamping plate 60. A channel of generally circular cross section extends through the supporting plate 58 adjacent surface 68 and generally perpendicular to the tongue 66. A fulcrum rod 70 is mounted in the channel of supporting plate 58 such that a portion of the fulcrum rod 70 extends slightly from surface 68. The fulcrum rod 70 is spaced from the mounting structure 71 which is connected to appropriate means for driving the clamp die 22 about the axis of the bending die 20. As a result, the fulcrum rod 70 prevents face-to-face contact between the supporting plate 58 and the clamping plate 60. Rather, the clamping plate 60 is able to rotate slightly about the fulcrum rod 70. This slight rotation of the clamping plate 60 enables the clamping plate 60 to move in response to the thinning of the rectangular tube 12 during a bend, and thereby ensures secure gripping throughout a bend. Furthermore, this pivotal motion enabled by the fulcrum rod 70 substantially eliminates tooling marks that would otherwise be caused by the serrations in the clamping surfaces 62 and 64 as a bend of the rectangular tube 12 is carried out.

In operation, the clamping die 22 would be moved into a position to securely hold the rectangular tube 12 against the bending die 20. More particularly, if the tube 12 is to be bent around an axis extending parallel to its major sides 13 and 14, the tube 12 will be positioned between the major clamping surface 62, the tongue 66, the bending surface 30 and the first support plate 32 of bending die 20. Conversely, if the rectangular tube 12 is to be bent around an axis extending parallel to the minor sides 15 and 16, the tube 12 will be positioned between minor clamping surface 64, tongue 66, bending surface 30 and the second support plate 34 of bending die 20. After the tube 12 has been properly positioned, the bend is effected by moving the bending die 20 and the clamp die 22 about the rotational axis in substantially the same manner as with prior art benders.

The pressure die 24 of the bending apparatus 10 comprises major and minor pressure surfaces 72 and 74 and tongue 76 extending perpendicularly away from the major and minor pressure surfaces 72 and 74. The major pressure surface 72 has a height indicated by dimension "a" which is substantially equal to the height of the major clamping surface 62 on the clamp die 22. Similarly, the minor pressure surface 74 has a height "b" substantially equal to the height of the minor clamping surface 64 on clamp die 22. The major and minor pressure surfaces 72 and 74 are parallel to one another but are offset by a dimension "g" which is equal to the offset between the major and minor clamping surfaces 62 and 64, and which also is equal to the difference between the width of two adjacent sides on the rectangular tube 12. The tongue 76 of pressure die 24 extends from the major pressure surface 72 a distance at least equal to dimension "b" and extends from the minor pressure surface 74 a distance at least equal to dimension "a." Although the clamp die 22 and pressure die 24 are functionally quite different, they have virtually identical cross-sectional dimensions. As a result of these dimensions, the pressure die 24 can securely retain the rectangular tube 12 against the bending die 20 and the wiper die 40. More particularly, when the tube 12 is being bent around an axis parallel to the major sides 13 and 14, the tube 12 will be securely retained between the major pressure surface 72, the tongue 76, the support surface 55 and the first support 52 of wiper die 40. When the tube 12 is being bent around an axis extending parallel to the minor sides 15 and 16, the tube 12 will be securely retained between the minor pressure surface 74, tongue 76, support surface 55 of wiper die 40 and the second support 54 thereof.

The pressure die 24 is further characterized by opposed leading and trailing ends 77 and 78. The leading end 77 defines the end thereof that will be adjacent the clamp die 22 at the beginning of a bending operation. The tongue 76 of pressure die 24 is movable in its own plane relative to the major and minor pressure surfaces 72 and 74 and alternately toward and away from the leading and trailing ends 77 and 78. The pressure die 24 further comprises a spring 80 extending between the trailing end 78 of the pressure die 24 and the tongue 76. The spring 80 is operative to urge the tongue 76 toward the leading end 77 of the pressure die 24. However, a sufficient force on the tongue 76 will overcome the force exerted by spring 80 and urge the tongue 76 toward the trailing end 78 of pressure die 24.

The pressure die booster 26 includes a rod 82 which is connected to the trailing end of backer bar 83 which in turn is secured to the pressure die 24. The pressure die booster 26 is operative to urge the pressure die 24 in a generally tangential direction toward the clamp die 22. The object of the pressure die booster 26 is to urge the tube 12 into the bend to prevent excessive thinning on the outermost wall of the tube. The ability of the tongue 76 to move relative to the remainder of the pressure die 24 ensures that contact between the trailing corner 86 of the clamp die tongue 66 and the leading corner 88 of pressure die tongue 76 will not affect the ability of the pressure die booster 26 from urging tube 12 into the bend. Thus, the pressure die 24 will urge a sufficient amount of the tubing 12 into the bend thereby preventing excessive thinning and the associated weakening or failure of the tube 12 at the bend.

The mandrel 28 of the bending apparatus 10 includes a substantially rigid arm 90 which is of generally rectangular cross section. More particularly, the rigid arm 90 includes a major width "c'" and a minor width "d'" which are slightly less than the major and minor internal dimensions "c" and "d" of the rectangular tube 12. The mandrel 28 further includes a replaceable head 92 which is securely but removably mounted to the end of the rigid arm 90. The replaceable head 92 has a cross section substantially identical to the cross section of the rigid arm 90.

Mandrel 28 further includes blocks 94 and 96 which are movably mounted to the replaceable head 92. The blocks 94 and 96 have a cross-sectional size and shape substantially the same as the cross-sectional size and shape of the replaceable head 92. The relative movement between the block 94 and the replaceable head 92 is effected by virtue of a ball and socket joint which comprises a spherical socket 98 in the block 94 into which a spherical stud 100 is engaged. The stud 100 in turn is securely mounted to the replaceable head 92. As a result, the block 94 is able to swivel around all axes relative to the replaceable head 92. This multidirectional swiveling enables the mandrel to be used for bends about either of the two axes of the tube. In a similar manner, the block 96 is provided with a spherical socket 102 into which a spherical stud 104 is mounted. The stud 104 also is securely affixed to the block 94. Consequently, block 96 can swivel relative to the block 94. On certain types of tubes, and with certain specific bending specifications, it may be necessary or desirable to provide more than two blocks capable of swiveling relative to one another.

The mandrel 28 will be inserted into the rectangular tube 12 a sufficient distance for the replaceable head 92 and the blocks 94 and 96 to be located substantially at the beginning of the bend. The mandrel 28 functions to prevent any severe deformation of the tube as the bend is carried out. The tube will be moved relative to the mandrel as the bends are carried out at different locations along the tube. The mandrel will periodically be rotated 90° to accommodate bends that are carried out around different axes of the rectangular tube 12.

After a complete set of bends is placed in the rectangular tube 12, the bent tube 12 is removed from the mandrel, and a new straight tube 12 is mounted thereon. With circular tubing, the insertion of the mandrel into the tube is effected with relative ease because the circular balls at the end of the mandrel are always symmetrically disposed relative to one another. The mandrel 28, however, is not symmetrical about all cross-sectional axes. As a result, the blocks 94 and 96 (which correspond to the balls on a mandrel for circular tubing) are not automatically aligned with one another. Consequently, the placement of the mandrel 28 into the rectangular tube 12 conceivably could require careful and potentially dangerous manual alignment. The subject mandrel avoids this problem by providing alignment springs 106 and 108 which extend from the replaceable head 92 through block 94 and to block 96. The springs 106 and 108 extend generally parallel to one another and on substantially opposite sides of the respective ball and socket joints of the mandrel 28. The springs 106 and 108 will ensure a substantially symmetrical alignment of blocks 94 and 96 relative to the replaceable head 92. This symmetrical alignment enables and facilitates the insertion of the mandrel 28 into the tube 12 without manual alignment.

As noted above, substantial forces are exerted upon the mandrel during a normal bending operation. Furthermore, there is substantial friction created as the tube bends relative to the mandrel. In view of these forces, substantial lubrication of the mandrel is necessary. To facilitate this lubrication, the rigid arm 90 is provided with a central channel 110 which in turn communicates with a plurality of outwardly extending lubricating channels 112. The lubricating channels 112 extend completely to the outer surface of the rigid arm 90. The central channel is in communication with a source of lubrication. Thus, prior and during a bending operation, a lubricant is directed through the central channel 110. The lubricant in turn is urged through the lubricating channels 112 to achieve proper lubrication between the mandrel 28 and the rectangular tube 12.

Despite the presence of the lubricant, substantial forces are exerted upon the swiveling blocks 94 and 96 and upon the replaceable head 92. These forces will ultimately wear the end of the mandrel. When the wear reaches an unacceptable limit, the replaceable head 92 need merely be removed from the rigid arm 90. A new replaceable head 92 with associated blocks 94 and 96 will then be attached to the rigid arm 90. This replaceability avoids the need to entirely replace the costly mandrel 28.

In operation, the rectangular tube 12 is telescopingly slid over the mandrel 28 an amount which positions the replaceable head 92 and the blocks 94 and 96 substantially in line with the required location for the first bend in the rectangular tube 12. The mandrel 28 and the tube 12 mounted thereon are then rotated into the proper alignment for the first bend. The clamping die 20 and the pressure die 24 are then urged radially inwardly to securely engage the tube 12 against the bending die 20 and the leading and trailing wiper dies 38 and 40. As explained above, the tube 12 will be positioned on one side or the other of tongues 66 and 76 depending upon the axis of tube 12 about which the bend will be effected. The bending is carried out by generally known techniques with the clamp die 22 and the bending die 20 moving about the rotational axis. To ensure that excessive thinning of the outer wall of the tube 12 does not occur, the pressure die 24 is urged by the pressure die booster 26 toward the clamp die 22. This advancement of the pressure die 24 by the pressure die booster 26 will urge the leading corner 88 of the pressure die tongue 76 into the trailing corner 86 of the clamp die tongue 66. However, the pressure die tongue 76 will yield in response to this contact thereby enabling continued advancement of the remainder of pressure die 24. Despite the movement of the pressure die 24 into the bend, some thinning of the radially outermost wall of tube 12 will occur. To ensure proper gripping by the clamp die 22 despite this thinning, the clamping plate 60 of the clamp die 20 will pivot around the pivot rod 70. The maximum range of this pivoting movement reflects the maximum amount of thinning anticipated. This pivoting movement will also prevent excessive tooling marks on the rectangular tube 12, which otherwise may be present. Throughout this bending, lubricant will be urged through the central channel 110 of the mandrel 28 and out through the lubricating channels 112. After a bend has been completed, the clamp die 22 and pressure die 24 will be moved radially outwardly and back to their initial position relative to one another. The tube 12 will then be advanced longitudinally into a position to receive the next bend. If this next bend is about a different axis, the tube 12 and the mandrel 28 will be rotated 90° and will also be moved to the opposite side of the tongues 66 and 76. The next bending operation will proceed as indicated above.

While the invention has been described relative to a preferred embodiment, it is apparent that various modifications can be made without departing from the scope of the invention as defined by the appended claims.

What is claimed is:

1. An apparatus for bending a rectangular tube having first and second pairs of opposed parallel sides, said apparatus comprising:

a bending die having a bending surface defining an arc of a cylinder, said bending die being selectively rotatable about the axis of the cylinder;

a clamp die having a clamping surface for clamping the rectangular tube against the bending surface of the bending die, said clamp die being movable through a generally circular arc relative to the axis of the cylindrical bending surface of the bending die to bend the rectangular tube around said bending surface, said clamp die including opposed leading and trailing ends which respectively lead and trail the clamp die through its movement for bending the rectangular tube;

a pressure die disposed substantially adjacent the bending die and the trailing end of said clamp die, said pressure die having a pressure surface for engaging one said side of the rectangular tube, said pressure surface being aligned generally parallel to the rotational axis of the bending die, said pressure die comprising a tongue extending from the pressure surface toward the bending die, said pressure die being operative to move in a generally tangential direction relative to the bending die toward the clamp die as the clamp and bending dies move about said axis, at least selected portions of said tongue being movable relative to the remainder of the pressure die toward and away from the trailing end of the clamp die, whereby the movable portion of said tongue will move enabling the remainder of the pressure die to be urged toward the clamp die as the clamp die moves through the circular arc.

2. An apparatus as in claim 1 wherein the first and second pairs of opposed sides of the rectangular tube define unequal major and minor widths respectively, said clamping surface of said clamp die defining a major clamping surface dimensioned to engage a major side of said rectangular tube, and a minor clamping surface dimensioned to engage a minor side of said rectangular tube.

3. An apparatus as in claim 2 wherein the major and minor clamping surfaces are generally in parallel relationship to one another.

4. An apparatus as in claim 3 wherein the tongue is disposed intermediate said major and minor clamping surfaces and extending perpendicularly therefrom, said tongue extending from said major clamping surface a distance generally equal to or greater than the minor width of said rectangular tube, and extending from said minor clamping surface a distance generally equal to or greater than the major width of said tube.

5. An apparatus as in claim 4 wherein the tongue of said clamp die is generally perpendicular to the axis about which said clamp die moves.

6. An apparatus as in claim 4 wherein said clamp die comprises a clamp plate and a support plate, said major and minor clamping surfaces being disposed on the clamp plate, said support plate being generally parallel to said clamping plate and being disposed substantially adjacent the side thereof opposite the major and minor clamping surfaces, said clamp die further comprising a pivot rod extending generally parallel to the axis about which said clamp die moves, said pivot rod maintaining said clamping and support plates in slightly spaced relationship and permitting pivotal movement therebetween.

7. An apparatus as in claim 4 wherein the major and minor clamping surfaces of said clamp die include a plurality of serrations.

8. An apparatus as in claim 4 wherein the bending die includes a groove extending into the bending surface thereof, said groove being dimensioned and disposed on said bending surface to engage the tongue of said clamp die.

9. An apparatus as in claim 8 wherein the bending die includes first and second supports extending generally parallel to said groove and perpendicular to said surface, said first support being spaced from said groove by a distance substantially equal to the major width of said tube and said second support being spaced from said groove by a distance substantially equal to the minor width of said tube.

10. An apparatus as in claim 4 wherein the pressure die comprises a tongue extending from the pressure surface thereof, the tongue comprising the movable portion of said pressure die.

11. An apparatus as in claim 10 wherein the pressure surface of said pressure die defines a major pressure surface and a minor pressure surface parallel to but spaced from said major pressure surface, said tongue being perpendicular to said major and minor pressure surfaces and being disposed therebetween.

12. An apparatus as in claim 11 wherein the major pressure surface extends from said tongue a distance substantially equal to the major width of said rectangular tube, and wherein said minor pressure surface extends from said tongue a distance substantially equal to the minor width of said rectangular tube.

13. An apparatus as in claim 12 wherein the tongue of said pressure die extends from said major pressure surface a distance generally equal to or greater than the minor width of said rectangular tube and wherein the tongue of said pressure die extends from the minor pressure surface a distance generally equal to or greater than the major width of said rectangular tube.

14. An apparatus as in claim 1 further comprising a pressure die booster for moving the pressure die in a generally tangential direction toward or away from the clamp die.

15. An apparatus as in claim 1 further comprising a mandrel dimensioned to be slidably inserted within said rectangular tube, said mandrel including a substantially rigid arm of generally rectangular cross section and a plurality of blocks pivotally mounted thereto for movement about a plurality of different axes.

16. An apparatus as in claim 15 further comprising means for aligning the blocks of said mandrel to the rigid arm thereof.

17. An apparatus as in claim 16 where the aligning means comprises a plurality of elongated flexible members extending between the rigid arm and the block adjacent thereto and further extending between adjacent blocks of said mandrel.

18. An apparatus as in claim 17 wherein the end of said rigid arm adjacent said blocks defines a head removably mounted to said rigid arm.

19. An apparatus as in claim 14 wherein the rigid arm of said mandrel includes a plurality of lubricating channels and wherein said apparatus further comprises a source of lubrication in communication with said lubricating channels.

20. A mandrel for bending rectangular tubes, said mandrel comprising a rigid arm of rectangular cross section dimensioned to fit within the tube and a plurality of blocks pivotally mounted to said rigid arm for movement about a plurality of different axes, each said block being of generally rectangular cross section and being dimensioned to fit within the tube, said mandrel further comprising means for substantially symmetrically aligning the rectangular blocks of said mandrel to the rigid rectangular arm thereof to facilitate the insertion of said rectangular blocks into the rectangular tube, the aligning means comprising a plurality of spaced apart elongate flexible members extending between the rigid arm and the block adjacent thereto, and a plurality of spaced apart elongated flexible members extending between each pair of adjacent blocks of said mandrel, whereby the spaced apart elongate flexible members enable a substantially symmetrical alignment of the rectangular blocks with the rectangular arm to facilitate insertion of said mandrel into the rectangular tube.

21. A mandrel as in claim 20 wherein the end of said rigid arm adjacent said blocks defines a head removably mounted to the remainder of said rigid arm.

22. A mandrel as in claim 20 wherein the rigid arm thereof includes a plurality of lubricating channels extending from a portion of said mandrel remote from said blocks to a plurality of locations intermediate said blocks and said end remote therefrom.

23. An apparatus for bending a rectangular tube having first and second pairs of opposed parallel sides defining unequal major and minor widths respectively, said apparatus comprising:

a bending die having a bending surface defining an arc of a cylinder, said bending die being selectively rotatable about the axis of the cylinder;

a clamp die having parallel major and minor clamping surfaces respectively for clamping a selected one of the major and minor width sides of the rectangular tube against the bending surface of the bending die, said clamp die being movable through a generally circular arc relative to the axis of the cylindrical bending surface of the bending die to bend the rectangular tube around said bending surface, said clamp die including opposed leading and trailing ends which respectively lead and trail the clamp die through its movement for bending the rectangular tube;

a pressure die disposed substantially adjacent the bending die and the trailing end of said clamp die, said pressure die having parallel major and minor pressure surfaces respectively for engaging a selected one of the major and minor width sides of the rectangular tube, said pressure die being operative to move in a generally tangential direction relative to the bending die toward the clamp die as the clamp and bending dies move about said axis, selected portions of said pressure die nearest the bending surface of the bending die being movable relative to the remainder of the pressure die toward and away from the trailing end of the clamp die, whereby the movable portion of said pressure die is operative to move upon contact with the clamp die, thereby enabling the remainder of the pressure die to be urged toward the clamp die as the clamp die moves through the circular arc.

24. An apparatus as in claim 23 wherein the clamp and pressure dies each further comprises a tongue disposed intermediate said major and minor clamping surfaces thereof and extending perpendicularly therefrom generally toward the bending die, such that said tongue of said pressure die defines the portion of said pressure die nearest the bending surface of the bending die.

25. An apparatus for bending a rectangular tube having first and second pairs of opposed parallel sides defining unequal major and minor widths respectively, said apparatus comprising:

a bending die having a bending surface defining an arc of a cylinder, said bending die being selectively rotatable about the axis of the cylinder;

a clamp die having parallel major and minor clamping surfaces respectively for clamping a selected one of the major and minor width sides of the rectangular tube against the bending surface of the bending die, the clamp die further comprising a tongue disposed intermediate said major and minor clamping surfaces and extending perpendicularly therefrom, said tongue extending from said major clamping surface a distance generally equal to or greater than the minor width of said rectangular tube, and extending from said minor clamping surface a distance generally equal to or greater than the major width of said tube, said clamp die being movable through a generally circular arc relative to the axis of the cylindrical bending surface of the bending die to bend the rectangular tube around said bending surface, said clamp die including opposed leading and trailing ends which respectively lead and trail the clamp die through its movement for bending the rectangular tube;

a pressure die disposed substantially adjacent the bending die and the trailing end of said clamp die, said pressure die having parallel major and minor pressure surfaces respectively for engaging a selected one of the major and minor width sides of the rectangular tube, said pressure die being operative to move in a generally tangential direction relative to the bending die toward the clamp die as the clamp and bending dies move about said axis, selected portions of said pressure die nearest the bending die being movable relative to the remainder of the pressure die toward and away from the trailing end of the clamp die, whereby the movable portion of said pressure die will move enabling the remainder of the pressure die to be urged toward the clamp die as the clamp die moves through the circular arc.

* * * * *